US012091954B2

(12) United States Patent
Damm et al.

(10) Patent No.: US 12,091,954 B2
(45) Date of Patent: Sep. 17, 2024

(54) OPERATION OF A RECIRCULATION CIRCUIT FOR A FLUID PUMP OF A HYDRAULIC FRACTURING SYSTEM

(71) Applicant: Caterpillar Inc., Peoria, IL (US)

(72) Inventors: Shawn M. Damm, Houston, TX (US); Yuesheng He, Sugar Land, TX (US); Sri Harsha Uddanda, Cypress, TX (US); Todd Ryan Kabrich, Tomball, TX (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 18/168,252

(22) Filed: Feb. 13, 2023

(65) Prior Publication Data

US 2024/0271513 A1 Aug. 15, 2024

(51) Int. Cl.
*E21B 43/26* (2006.01)

(52) U.S. Cl.
CPC ..... *E21B 43/2607* (2020.05); *E21B 43/26* (2013.01)

(58) Field of Classification Search
CPC ..... E21B 43/26; E21B 43/2607
See application file for complete search history.

(56) References Cited

U.S. PATENT DOCUMENTS

| | | | | |
|---|---|---|---|---|
| 5,775,879 | A | 7/1998 | Durando | |
| 9,133,690 | B1 | 9/2015 | Tanju et al. | |
| 9,512,700 | B2 | 12/2016 | Becquin et al. | |
| 9,803,457 | B2 | 10/2017 | Shampine et al. | |
| 10,385,669 | B2 | 8/2019 | Hodgson et al. | |
| 2018/0073346 | A1* | 3/2018 | Urdaneta | G05B 19/02 |

* cited by examiner

*Primary Examiner* — James G Sayre
(74) *Attorney, Agent, or Firm* — Harrity & Harrity, LLP

(57) ABSTRACT

A control system may include a recirculation circuit configured to direct fluid from an outlet of a fluid pump of a hydraulic fracturing system to an inlet of the fluid pump. The control system may include a control valve in the recirculation circuit. The control system may include a choke valve in the recirculation circuit. The control system may include a controller configured to cause opening of the control valve to cause the fluid to flow through the recirculation circuit, and cause, based on a pressure of the fluid flowing through the recirculation circuit downstream of the control valve and the choke valve, actuation of the choke valve to maintain the pressure of the fluid below a threshold.

20 Claims, 3 Drawing Sheets

OPERATION OF A RECIRCULATION CIRCUIT FOR A FLUID PUMP OF A HYDRAULIC FRACTURING SYSTEM

TECHNICAL FIELD

The present disclosure relates generally to fluid pumps and, for example, to operation of a recirculation circuit for a fluid pump of a hydraulic fracturing system.

BACKGROUND

Hydraulic fracturing is a well stimulation technique that typically involves pumping hydraulic fracturing fluid into a wellbore at a rate and a pressure (e.g., up to 15,000 pounds per square inch (psi)) sufficient to form fractures in a rock formation surrounding the wellbore. This well stimulation technique often enhances the natural fracturing of a rock formation to increase the permeability of the rock formation, thereby improving recovery of water, oil, natural gas, and/or other fluids.

A hydraulic fracturing system may employ one or more fluid pumps for pressurizing hydraulic fracturing fluid. A fluid pump has a suction side, at which low-pressure fluid enters the fluid pump to be pressurized, and a discharge side at which high-pressure fluid pressurized by the fluid pump exits the fluid pump. Pump hardware at the discharge side of the fluid pump may be configured to handle high pressures associated with hydraulic fracturing. However, a pressure-containment capability of pump hardware at the suction side of the fluid pump may be less than a pressure-containment capability of the pump hardware at the discharge side of the fluid pump. As a result, the suction side of the fluid pump may be unable to handle the high pressures associated with hydraulic fracturing. Accordingly, high-pressure fluid reaching the suction side of the fluid pump may result in leaking or failure (e.g., burst failure) of the fluid pump.

The control system of the present disclosure solves one or more of the problems set forth above and/or other problems in the art.

SUMMARY

A pump system of a hydraulic fracturing system may include a fluid pump having an inlet and an outlet and a recirculation circuit configured to direct fluid from the outlet of the fluid pump to the inlet of the fluid pump. The pump system may include a control valve, in the recirculation circuit, configured for actuation between an open position and a closed position. The pump system may include a choke valve, in the recirculation circuit, configured to provide a pressure drop from a discharge pressure of the fluid pump. The pump system may include a controller configured to cause opening of the control valve to cause the fluid to flow through the recirculation circuit. The controller may be configured to obtain information indicating a pressure of the fluid flowing through the recirculation circuit downstream of the control valve and the choke valve. The controller may be configured to cause, based on the pressure of the fluid, actuation of the choke valve to maintain the pressure of the fluid below a threshold.

A control system may include a recirculation circuit configured to direct fluid from an outlet of a fluid pump of a hydraulic fracturing system to an inlet of the fluid pump. The control system may include a control valve in the recirculation circuit. The control system may include a choke valve in the recirculation circuit. The control system may include a controller configured to cause opening of the control valve to cause the fluid to flow through the recirculation circuit. The controller may be configured to cause, based on a pressure of the fluid flowing through the recirculation circuit downstream of the control valve and the choke valve, actuation of the choke valve to maintain the pressure of the fluid below a threshold.

A method may include causing, by a controller, pumping by a fluid pump of a hydraulic fracturing system. The method may include causing, by the controller, opening of a control valve to cause fluid to flow through a recirculation circuit that directs the fluid from an outlet of the fluid pump to an inlet of the fluid pump, the recirculation circuit including the control valve and a choke valve. The method may include obtaining, by the controller, information indicating a pressure of the fluid flowing through the recirculation circuit downstream of the control valve and the choke valve. The method may include causing, by the controller and based on the pressure of the fluid, actuation of the choke valve to maintain the pressure of the fluid below a threshold.

DETAILED DESCRIPTION

Figure 1:
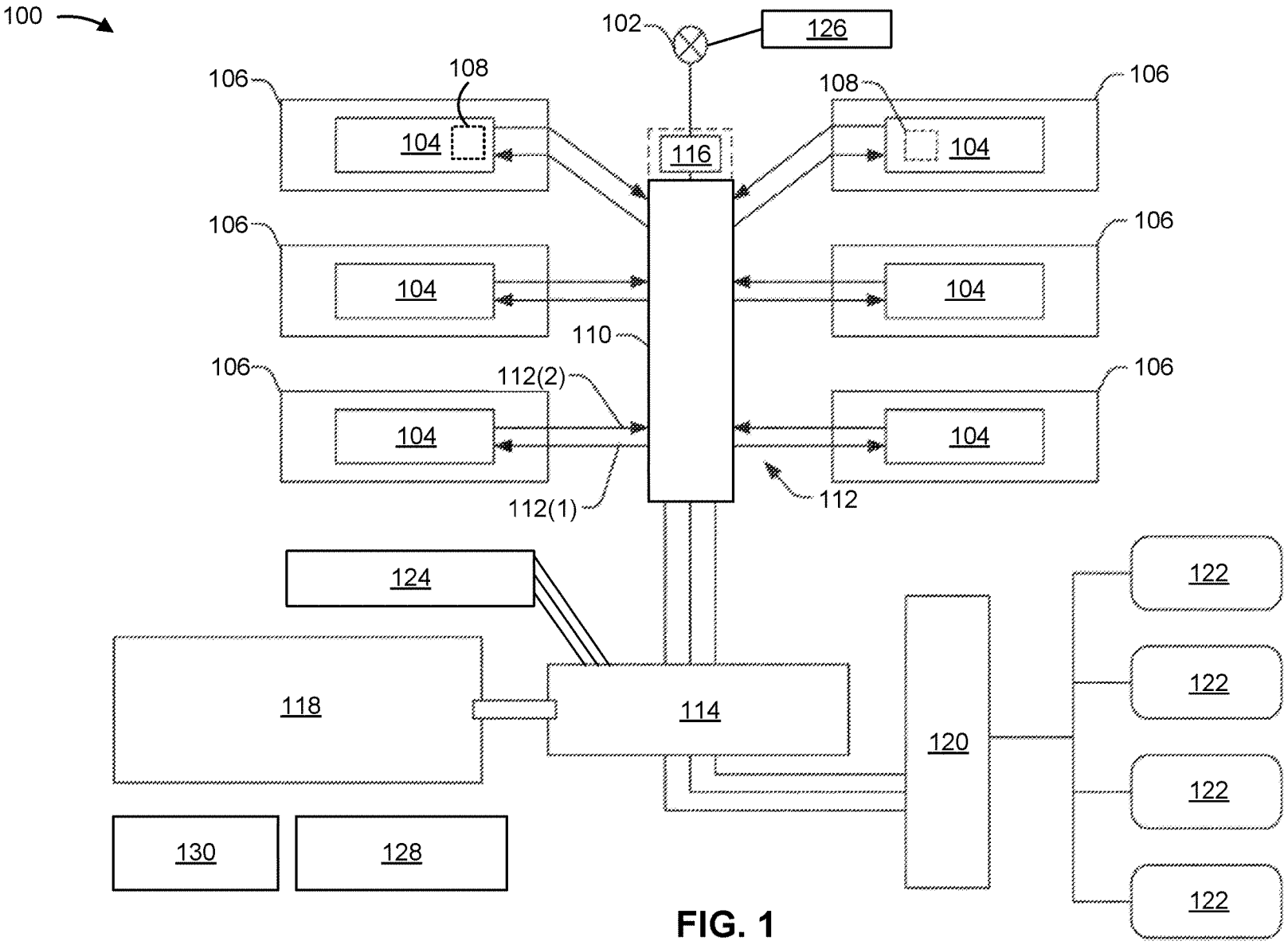
FIG. 1 is a diagram illustrating an example hydraulic fracturing system.

FIG. 1 is a diagram illustrating an example hydraulic fracturing system 100. For example, FIG. 1 depicts a plan view of an example hydraulic fracturing site along with equipment that is used during a hydraulic fracturing process. In some examples, less equipment, additional equipment, or alternative equipment to the example equipment depicted in FIG. 1 may be used to conduct the hydraulic fracturing process.

The hydraulic fracturing system 100 includes a well 102. Hydraulic fracturing is a well-stimulation technique that uses high-pressure injection of fracturing fluid into the well 102 and corresponding wellbore in order to hydraulically fracture a rock formation surrounding the wellbore. While the description provided herein describes hydraulic fracturing in the context of wellbore stimulation for oil and gas production, the description herein is also applicable to other uses of hydraulic fracturing.

High-pressure injection of the fracturing fluid may be achieved by one or more pump systems 104 that may be mounted (or housed) on one or more hydraulic fracturing trailers 106 (which also may be referred to as "hydraulic fracturing rigs") of the hydraulic fracturing system 100. Each of the pump systems 104 includes at least one fluid pump 108 (referred to herein collectively, as "fluid pumps 108" and individually as "a fluid pump 108"). Each of the pump systems 104 may also include at least one prime mover for a fluid pump 108, such as an engine or a motor, which may share a housing with the fluid pump 108. The fluid pumps 108 may be hydraulic fracturing pumps. The fluid pumps 108 may include various types of high-volume hydraulic fracturing pumps such as triplex or quintuplex pumps. Additionally, or alternatively, the fluid pumps 108 may include other types of reciprocating positive-displacement pumps or gear pumps. A type and/or a configuration of the fluid pumps 108 may vary depending on the fracture gradient of the rock formation that will be hydraulically fractured, the quantity of fluid pumps 108 used in the hydraulic fracturing system 100, the flow rate necessary to complete the hydraulic fracture, the pressure necessary to complete the hydraulic fracture, or the like. The hydraulic fracturing system 100 may include any number of trailers 106 having fluid pumps 108 thereon in order to pump hydraulic fracturing fluid at a predetermined rate and pressure.

In some examples, the fluid pumps 108 may be in fluid communication with a manifold 110 via various fluid conduits 112, such as flow lines, pipes, or other types of fluid conduits. For example, each fluid pump 108 may be configured to discharge fluid to the manifold 110. The manifold 110 combines fracturing fluid received from the fluid pumps 108 prior to injecting the fracturing fluid into the well 102. The manifold 110 also distributes fracturing fluid to the fluid pumps 108 that the manifold 110 receives from a blender 114 of the hydraulic fracturing system 100. In some examples, the various fluids are transferred between the various components of the hydraulic fracturing system 100 via the fluid conduits 112. The fluid conduits 112 include low-pressure fluid conduits 112(1) and high-pressure fluid conduits 112(2). In some examples, the low-pressure fluid conduits 112(1) deliver fracturing fluid from the manifold 110 to the fluid pumps 108, and the high-pressure fluid conduits 112(2) transfer high-pressure fracturing fluid from the fluid pumps 108 to the manifold 110.

The manifold 110 also includes a fracturing head 116. The fracturing head 116 may be included on a same support structure as the manifold 110. The fracturing head 116 receives fracturing fluid from the manifold 110 and delivers the fracturing fluid to the well 102 (via a well head mounted on the well 102) during a hydraulic fracturing process. In some examples, the fracturing head 116 may be fluidly connected to multiple wells.

The blender 114 combines proppant received from a proppant storage unit 118 with fluid received from a hydration unit 120 of the hydraulic fracturing system 100. In some examples, the proppant storage unit 118 may include a dump truck, a truck with a trailer, one or more silos, or other types of containers. The hydration unit 120 receives water from one or more water tanks 122. In some examples, the hydraulic fracturing system 100 may receive water from water pits, water trucks, water lines, and/or any other suitable source of water. The hydration unit 120 may include one or more tanks, pumps, gates, or the like.

The hydration unit 120 may add fluid additives, such as polymers or other chemical additives, to the water. Such additives may increase the viscosity of the fracturing fluid prior to mixing the fluid with proppant in the blender 114. The additives may also modify a pH of the fracturing fluid to an appropriate level for injection into a targeted formation surrounding the wellbore. Additionally, or alternatively, the hydraulic fracturing system 100 may include one or more fluid additive storage units 124 that store fluid additives. The fluid additive storage unit 124 may be in fluid communication with the hydration unit 120 and/or the blender 114 to add fluid additives to the fracturing fluid.

In some examples, the hydraulic fracturing system 100 may include a balancing pump 126. The balancing pump 126 provides balancing of a differential pressure in an annulus of the well 102. The hydraulic fracturing system 100 may include a data monitoring system 128. The data monitoring system 128 may manage and/or monitor the hydraulic fracturing process performed by the hydraulic fracturing system 100 and the equipment used in the process. In some examples, the management and/or monitoring operations may be performed from multiple locations. The data monitoring system 128 may be supported on a van, a truck, or may be otherwise mobile. The data monitoring system 128 may include a display for displaying data for monitoring performance and/or optimizing operation of the hydraulic fracturing system 100. In some examples, the data gathered by the data monitoring system 128 may be sent off-board or off-site for monitoring performance and/or performing calculations relative to the hydraulic fracturing system 100.

The hydraulic fracturing system 100 includes a controller 130. The controller 130 may be a system-wide controller for the hydraulic fracturing system 100 or a pump-specific controller for a pump system 104. The controller 130 may be communicatively coupled (e.g., by a wired connection or a wireless connection) with one or more of the pump systems 104. The controller 130 may also be communicatively coupled with other equipment and/or systems of the hydraulic fracturing system 100. The controller 130 may include one or more memories and/or one or more processors. In some implementations, the controller 130 may be or may include a proportional-integral-derivative (PID) controller.

As indicated above, FIG. 1 is provided as an example. Other examples may differ from what is described with regard to FIG. 1.

Figure 2:
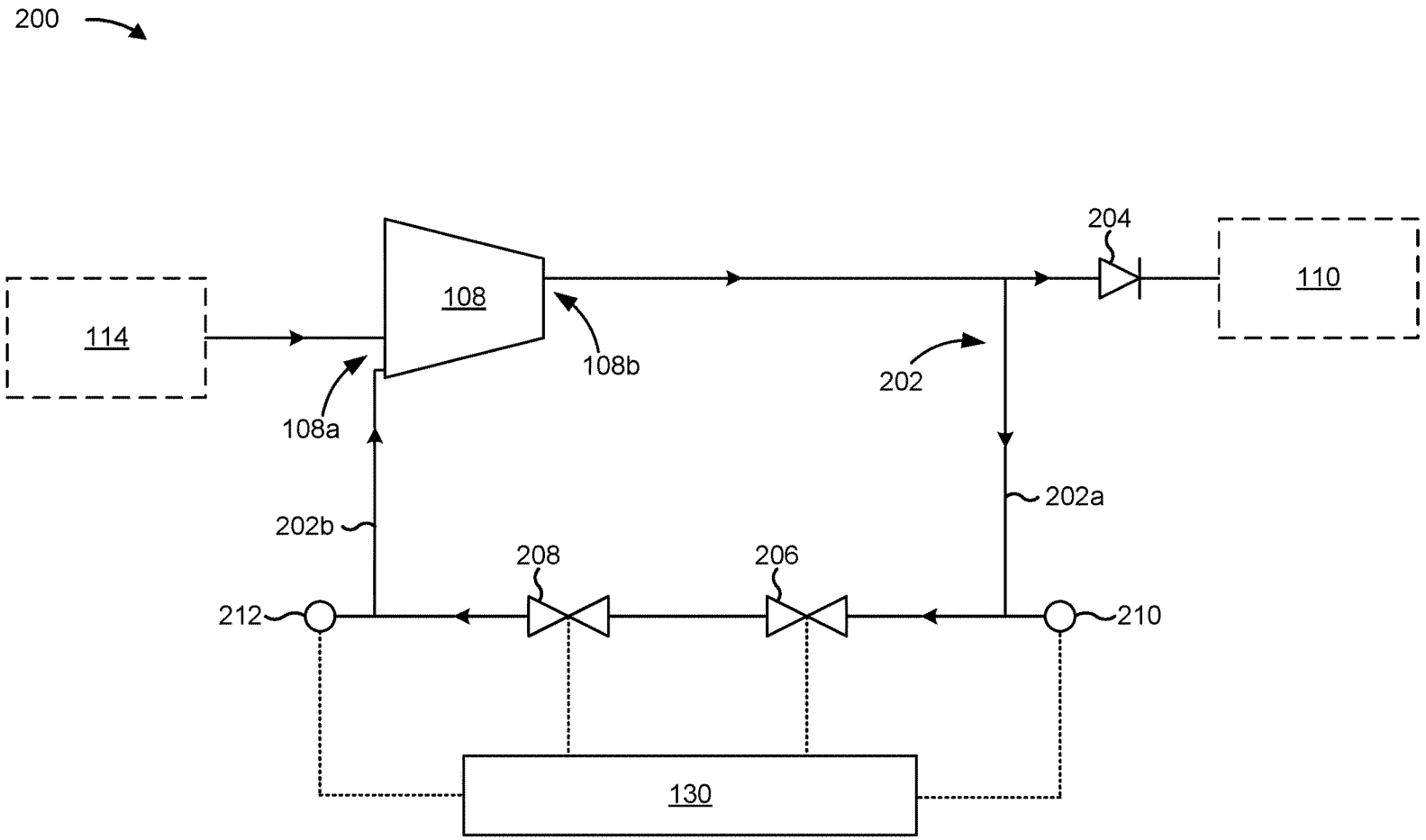
FIG. 2 is a diagram illustrating an example control system.

FIG. 2 is a diagram illustrating an example control system 200. The control system 200 may include one or more components of the hydraulic fracturing system 100, as described herein. In some examples, the control system 200 may be included in a pump system 104 of the hydraulic fracturing system 100.

As shown in FIG. 2, the control system 200 includes a fluid pump 108, the controller 130 (e.g., a pump-specific controller for the pump system 104), a recirculation circuit 202, a check valve 204, a control valve 206, a choke valve 208, a first pressure sensor 210 (referred to herein as a discharge pressure sensor 210), and/or a second pressure sensor 212 (referred to herein as a suction pressure sensor 212). The fluid pump 108 may receive fluid (e.g., hydraulic fracturing fluid) from the blender 114. The fluid pump 108 may be configured to pressurize the fluid and discharge the pressurized fluid to the manifold 110 (e.g., via the check valve 204) and/or to the recirculation circuit 202. For example, fluid received from the blender may be at a pressure in a range from 80 to 120 psi (e.g., 100 psi), and the fluid pump 108 may pressurize the fluid up to about 12,500 psi.

The fluid pump 108 includes an inlet 108*a* (which can be referred to as a low-pressure or suction side of the fluid pump 108) and an outlet 108*b* (which can be referred to as a high-pressure or discharge side of the fluid pump 108). The inlet 108*a* may include various inlet components configured to receive fluid (e.g., low-pressure fluid) and to provide the fluid to one or more pressurization components (e.g., cylinders) of the fluid pump 108 for pressurization. For example, the inlet components may include one or more fluid conduits, one or more couplers for the fluid conduits, and/or an inlet manifold, among other examples. The inlet manifold may be configured to receive one or more fluid flows and to provide the fluid flow(s) to separate pressurization components (e.g., separate cylinders) of the fluid pump 108 for pressurization. The outlet 108*b* may include various outlet components configured to receive pressurized fluid (e.g., high-pressure fluid) from the pressurization component(s) of the fluid pump 108 and to discharge the pressurized fluid from the fluid pump 108. For example, the outlet components may include one or more fluid conduits, one or more couplers for the fluid conduits, and/or an outlet manifold, among other examples.

The outlet components of the outlet 108*b* may have a first pressure containment capability (e.g., a pressure limit above which bursting or leaking will occur) that is greater than a second pressure containment capability of the inlet components of the inlet 108*a*. For example, a thickness of the walls of the outlet components of the outlet 108*b* may be greater than a thickness of the walls of the inlet components of the inlet 108*a*. As an example, the outlet components of the outlet 108*b* may be capable of withstanding a pressure of at least 5,000 psi, at least 10,000 psi, or at least 12,000 psi without leaking or bursting. In contrast, the inlet components of the inlet 108*a* may be capable of withstanding a pressure of at most 1,000 psi, at most 500 psi, or at most 300 psi without leaking or bursting.

The recirculation circuit 202 may include one or more fluid conduits configured to direct high-pressure fluid discharged from the fluid pump 108 to a low-pressure side of the fluid pump 108, which may reduce power consumed by a prime mover (e.g., an engine, a motor, or the like) of the fluid pump 108 and/or facilitate faster ramping up of the fluid pump 108. For example, the recirculation circuit 202 may be opened while a transmission coupled to the fluid pump 108 is shifting from neutral to a first gear, and the recirculation circuit 202 may be closed when the shift from neutral to the first gear is achieved (e.g., when the first gear is fully engaged). The recirculation circuit 202 may be configured to direct fluid from the outlet 108*b* of the fluid pump 108 to the inlet 108*a* of the fluid pump 108. For example, the outlet 108*b* of the fluid pump 108 (e.g., an outlet manifold) may include a first port for discharging fluid to the manifold 110 and a second port for discharging fluid to the recirculation circuit 202. Similarly, the inlet 108*a* of the fluid pump 108 (e.g., an inlet manifold) may include a first port for receiving fluid from the blender 114 or another supplier of fluid and a second port for receiving fluid from the recirculation circuit 202. Fluid discharged from the fluid pump 108 may enter the recirculation circuit 202 upstream of the manifold 110.

The check valve 204 may be downstream of the fluid pump 108 between the fluid pump 108 and the manifold 110. The check valve 204 may also be downstream of an entrance into the recirculation circuit 202. The check valve 204 may be configured to allow fluid flow in a forward direction from the fluid pump 108 to the manifold 110 and to prevent fluid flow in a reverse direction from the manifold 110 to the fluid pump 108 or to the recirculation circuit 202 (the prevention of fluid flow refers to an intended property of the check valve 204, and in some cases the check valve 204 may not provide absolute prevention of fluid flow due to wear or defect). For example, the check valve 204 may prevent the fluid pump 108 from receiving, via the recirculation circuit 202, high-pressure fluid from other pumps that discharge to the manifold 110 shared with the fluid pump 108. The check valve 204 may include a swing check valve, a ball check valve, a piston check valve, or the like. Wear or failure of the check valve 204 may permit reverse flow to the fluid pump 108 when the recirculation circuit 202 is used, thereby exposing the suction side of the fluid pump 108 to high-pressure fluid.

The control valve 206 (e.g., a ball valve) and the choke valve 208 may be in the recirculation circuit 202 between the outlet 108*b* of the fluid pump 108 and the inlet 108*a* of the fluid pump 108. The recirculation circuit 202 may be configured to direct fluid from the outlet 108*b* of the fluid pump 108, via a first portion 202*a* (referred to herein as a "discharge portion") of the recirculation circuit 202 that is upstream of the control valve 206 and the choke valve 208, to the inlet 108*a* of the fluid pump 108 via a second portion 202*b* (referred to herein as a "suction portion") of the recirculation circuit 202 that is downstream of the control valve 206 and the choke valve 208. The control valve 206 and the choke valve 208 may be between the discharge portion 202*a* of the recirculation circuit 202 and the suction portion 202*b* of the recirculation circuit 202. The control valve 206 may be upstream of the choke valve 208, as shown. Alternatively, the choke valve 208 may be upstream of the control valve 206.

The control valve 206 may be configured for actuation between an open position and a closed position. In the open position, the control valve 206 permits pressurized fluid discharged from the fluid pump 108 to flow through the recirculation circuit 202. In the closed position, the control valve 206 prevents pressurized fluid discharged from the fluid pump 108 from flowing through the recirculation circuit 202 (the prevention of fluid flow refers to an intended property of the control valve 206, and in some cases the control valve 206 may not provide absolute prevention of fluid flow due to wear or defect).

A discharge pressure of the fluid pump 108 may exceed a pressure containment capability at the suction side of the fluid pump 108 (e.g., at an inlet manifold of the fluid pump 108). Accordingly, recirculation may increase pressure at the suction side of the fluid pump 108 above the limits of the pump hardware, thereby resulting in leaking or failure (e.g., burst failure) of the fluid pump 108. In addition, a flow area through the control valve 206 may be small during transitioning of the control valve 206 from a fully closed position to a fully open position. This small flow area through the control valve 206 causes fluid flow through the control valve 206 at high velocity, which may cause abrasive wear to the control valve 206 (e.g., to sealing surfaces of the control valve 206). As a result, the control valve 206 may develop a leak and/or experience a reduced useful life.

The choke valve 208 may be configured to provide a pressure drop in the recirculation circuit 202 from the discharge pressure of the fluid pump 108 (e.g., from a high pressure above 10,000 psi to a low pressure below 300 psi). The choke valve 208 may include an orifice, and a size of the orifice may dictate an amount of fluid that can flow through the choke valve 208. The choke valve 208 may be in an adjustable configuration such that a size of the orifice may be varied to control a pressure of fluid in the recirculation circuit 202. For example, actuation of the choke valve 208 to a particular position may increase or decrease the size of the orifice to thereby increase or decrease, respectively, fluid flow through the choke valve 208.

The control valve 206 and the choke valve 208 may be communicatively connected (e.g., by wired connections or wireless connections) to the controller 130. For example, the controller 130 may provide position control commands to the control valve 206 indicating whether the control valve 206 is to be in the open position or the closed position. As another example, the controller 130 may provide position control commands to the choke valve 208 indicating a position, and thus an orifice size, of the choke valve 208.

The discharge pressure sensor 210 and the suction pressure sensor 212 may be in the recirculation circuit 202. The discharge pressure sensor 210 may be configured to detect a pressure of fluid in the discharge portion 202*a* of the recirculation circuit 202 upstream of the control valve 206 and the choke valve 208 (e.g., a pressure of fluid discharged from the outlet 108*b* of the fluid pump 108). For example, the discharge pressure sensor 210 may be between the outlet 108*b* of the fluid pump 108 and the control valve 206 and the choke valve 208. The suction pressure sensor 212 may be configured to detect a pressure of fluid in the suction portion 202*b* of the recirculation circuit 202 downstream of the control valve 206 and the choke valve 208 (e.g., a pressure of fluid entering the inlet 108*a* of the fluid pump 108 from the recirculation circuit 202). For example, the suction pressure sensor 212 may be between the control valve 206 and the choke valve 208 and the inlet 108*a* of the fluid pump 108. The discharge pressure sensor 210 and the suction pressure sensor 212 may be communicatively connected (e.g., by wired connections or wireless connections) to the controller 130. For example, the discharge pressure sensor 210 and the suction pressure sensor 212 may provide pressure information to the controller 130.

The controller 130 may be configured to perform operations associated with the recirculation circuit 202, as described herein. In some implementations, the controller 130 may perform operations to protect inlet components of the inlet 108*a* of the fluid pump 108 (e.g., that are associated with a low pressure containment capability) from high-pressure fluid entering the recirculation circuit 202 from the outlet 108*b* of the fluid pump 108. To prepare for fluid flow through the recirculation circuit 202 and while the control valve 206 is closed, the controller 130 may cause actuation of the choke valve 208 to an initial position. For example, the initial position may be a minimum flow position (a position of the choke valve 208 that results in a minimum fluid flow through the choke valve 208), a maximum flow position (a position of the choke valve 208 that results in a maximum fluid flow through the choke valve 208), or a position of the choke valve 208 that is between the minimum flow position and the maximum flow position. Use of the minimum flow position may ensure that high pressure fluid does not reach the inlet 108*a* of the fluid pump 108 when the control valve 206 is initially opened.

At a time when the recirculation circuit 202 is to be used, such as when the fluid pump 108 is being brought online, the controller 130 may cause opening of the control valve 206 to the open state to cause fluid to flow in the recirculation circuit 202. That is, opening of the control valve 206 may cause fluid discharged from the outlet 108*b* of the fluid pump 108 to be directed, via the recirculation circuit 202, to the inlet 108*a* of the fluid pump 108. The controller 130 may monitor a pressure of the fluid in the suction portion 202*b* of the recirculation circuit 202 downstream of the control valve 206 and the choke valve 208 (the pressure of the fluid that is to enter the inlet 108*a* of the fluid pump 108, and referred to herein as the "suction pressure"). To monitor the suction pressure, the controller 130 may obtain information indicating the suction pressure (e.g., while the control valve 206 is open). For example, the controller 130 may obtain the information indicating the suction pressure from the suction pressure sensor 212.

Based on the suction pressure, the controller 130 may cause (e.g., command) actuation of the choke valve 208 to maintain the suction pressure below a threshold. To cause actuation of the choke valve 208, the controller 130 may compute and transmit a position control command to the choke valve 208. For example, the controller 130 may determine a difference between the suction pressure and the threshold, and the actuation of the choke valve 208 may be based on the difference between the suction pressure and the threshold (e.g., using a PID control logic or another type of control logic). As used herein, maintaining the suction pressure below the threshold may refer to keeping the suction pressure below the threshold and/or responding to spikes in suction pressure at or above the threshold by lowering the suction pressure below the threshold. The threshold may be based on the pressure containment capability (e.g., the pressure limit) of the inlet 108*a* of the fluid pump 108, as described herein. For example, the threshold may be a pressure that is less than or equal to the pressure containment capability (e.g., 5%, 10%, or the like, less than the pressure containment capability). As an example, the threshold may be a pressure less than or equal to 300 psi.

The controller 130 may continuously (e.g., periodically with a sub-second periodicity) obtain information indicating the suction pressure, and cause, based on the suction pressure, actuation of the choke valve 208 continuously to maintain the suction pressure below the threshold. For example, the controller 130 may continuously modulate a position of the choke valve 208 to adjust a pressure of the fluid in the recirculation circuit 202.

In some implementations, causing actuation of the choke valve 208 may include causing increasing of fluid flow through the choke valve 208 (e.g., moving the position of the choke valve 208 to increase the size of the orifice of the choke valve 208) to maintain the suction pressure at a maximum pressure that is below the threshold. For example, the controller 130 may maximize the pressure of the fluid in the recirculation circuit 202, while maintaining the pressure below the threshold, to maximize an effect that the recirculation circuit 202 has in reducing power consumption in connection with operating the fluid pump 108.

In some implementations, causing actuation of the choke valve 208 may include causing decreasing of fluid flow through the choke valve 208 (e.g., moving the position of the choke valve 208 to decrease the size of the orifice of the choke valve 208) to maintain the suction pressure below the threshold. For example, if the suction pressure is approaching the threshold or hits the threshold, then the controller 130 may cause actuation of the choke valve 208 to a more closed position (decreasing the size of the orifice) until the suction pressure is below the threshold. In this way, the suction pressure may be maintained at a safe margin from the pressure containment capability of the inlet 108*a* of the fluid pump 108.

In some examples, the suction pressure may need to be decreased while the choke valve 208 is at a minimum flow position. In other words, the maximum amount of suction pressure reduction that can be provided by the choke valve 208 may be insufficient to maintain the suction pressure below the threshold. The controller 130 may cause closing of the control valve 206 based on the suction pressure being at or above the threshold and based on the choke valve 208 being at a minimum flow position. In this way, fluid flow through the recirculation circuit 202 may be halted if the choke valve 208 cannot reduce the suction pressure to safe levels.

In some implementations, the controller 130 may perform operations to protect the control valve 206 from high-velocity fluid (e.g., of 1000 feet-per-second or greater) flowing through the control valve 206 during opening of the control valve 206. To prepare for fluid flow through the recirculation circuit 202 and while the control valve 206 is closed, the controller 130 may determine a differential pressure of fluid in the recirculation circuit 202. The controller 130 may determine the differential pressure based on a first pressure of the fluid in the discharge portion 202*a* of the recirculation circuit upstream of the control valve 206 and the choke valve 208 (e.g., a discharge pressure at the outlet 108*b* of the fluid pump 108) and a second pressure of the fluid in the suction portion 202*b* of the recirculation circuit 202 downstream of the control valve 206 and the choke valve 208 (the suction pressure). The controller 130 may obtain information indicating the first pressure from the discharge pressure sensor 210, and the controller 130 may obtain information indicating the second pressure from the suction pressure sensor 212. In some implementations, the controller 130 may estimate a velocity of fluid that would flow through the control valve 206 during opening of the control valve 206 based on the differential pressure.

The controller 130 may identify, based on the differential pressure, a position for the choke valve 208 that is to result in a flow velocity through the control valve 206 that is below a threshold. The position may indicate a proportion of openness of the choke valve 208, an angular position of the choke valve 208, a linear position of the choke valve 208, or the like, that corresponds to a particular size of the orifice of the choke valve 208. The threshold may be based on a flow velocity limit of the control valve 206. For example, the threshold may be a velocity that is less than or equal to the flow velocity limit (e.g., 5%, 10%, or the like, less than the flow velocity limit). The flow velocity limit may be a maximum flow velocity (e.g., as indicated by a manufacturer of the control valve 206) beyond which abrasive wear to the control valve 206 may occur. In some implementations, the controller 130 may identify the position for the choke valve 208 based on the estimated velocity.

The controller 130 may identify the position for the choke valve 208 using data associating differential pressures with choke valve positions. For example, based on the differential pressure, the controller 130 may identify the position for the choke valve 208 based on an association between the differential pressure and the position for the choke valve 208 indicated by the data. In some implementations, the data may associate estimated fluid velocities with choke valve positions. The data may include a mapping, a table, a look-up table, a function that takes an input of differential pressure and returns a choke valve position, or the like. The controller 130 may store the data (e.g., in a memory of the controller 130) for use in identifying positions for the choke valve 208. The data may be based on a computational fluid dynamics (CFD) simulation (e.g., a three-dimensional CFD simulation). For example, the CFD simulation may identify positions of the choke valve 208, as a function of differential pressure, that provide an estimated fluid velocity across the control valve 206 that is below the threshold.

The controller 130 may cause actuation of the choke valve 208 in accordance with the position. For example, the controller 130 may transmit a position control command in accordance with the position to the choke valve 208 to cause actuation of the choke valve 208 to the position. After actuation of the choke valve 208, the controller 130 may cause opening of the control valve 206 to the open state to cause the fluid to flow in the recirculation circuit 202. That is, opening of the control valve 206 may cause fluid discharged from the outlet 108*b* of the fluid pump 108 to be directed, via the recirculation circuit 202, to the inlet 108*a* of the fluid pump 108. During opening of the control valve 206, the fluid may flow through the control valve 206 at or below the flow velocity associated with the position of the choke valve 208. Thus, by reducing the flow velocity through the control valve 206 during opening of the control valve 206, abrasive wear to the control valve 206 may be reduced.

During opening of the control valve 206 and/or while the control valve 206 is open, the controller 130 may continuously (e.g., periodically with a sub-second periodicity) determine differential pressures, identify positions for the choke valve 208 that are to result in flow velocities through the control valve 206 that are below the threshold, and cause actuation of the choke valve 208 in accordance with the positions. For example, the controller 130 may continuously modulate positions of the choke valve 208 to adjust flow velocity through the control valve 206.

High-velocity fluid may also flow through the control valve 206 during closing of the control valve 206. Thus, the controller 130 may control the choke valve 208 during closing of the control valve 206 in a similar manner as described above. For example, prior to closing of the control valve 206, the controller 130 may cause actuation of the choke valve 208 in accordance with the position identified for the choke valve 208. Alternatively, the controller 130 may cause actuation of the choke valve 208 during closing of the control valve 206. In some implementations, the controller 130 may identify a new position for the choke valve 208. For example, when the control valve 206 is open, the controller 130 may determine a differential pressure, identify based on the differential pressure, a position for the choke valve 208 that is to result in a flow velocity through the control valve 206 that is below the threshold, and cause actuation of the choke valve 208 in accordance with the position, in a similar manner as described above. Alternatively, prior to closing of the control valve 206, the controller 130 may determine estimated differential pressures at different choke valve positions based on the first pressure of the fluid in the discharge portion 202*a* of the recirculation circuit upstream of the control valve 206 and the choke valve 208 and using data associating differential pressures with choke valve positions. The controller 130 may identify based on the estimated differential pressures, a maximum flow position (a position of the choke valve 208 that results in a maximum fluid flow through the choke valve 208) for the choke valve 208 that is to result in a flow velocity through the control valve 206 that is below the threshold, and cause actuation of the choke valve 208 in accordance with the maximum flow position. After actuation of the choke valve 208, the controller 130 may cause closing of the control valve 206 to the closed state to halt fluid flow through the recirculation circuit 202. During closing of the control valve 206, the fluid may flow through the control valve 206 at or below the flow velocity associated with the position of the choke valve 208. Thus, by reducing the flow velocity through the control valve 206 during closing of the control valve 206, abrasive wear to the control valve 206 may be reduced.

In some implementations, the controller 130 may perform operations to assess a health of the check valve 204. For example, the operations may be associated with a test for determining whether the check valve 204 allows reverse flow. Reverse flow may refer to fluid flowing from downstream to upstream through the check valve 204, such as fluid flowing from the manifold 110 to the inlet 108*a* of the fluid pump 108 via the recirculation circuit 202. The test may be initiated manually by an operator of the fluid pump 108 or autonomously by the controller 130. For example, the controller 130 may receive an input (e.g., via a user interface, a user control, or the like), from an operator of the fluid pump 108, requesting a test of the check valve 204. As another example, the controller 130 may detect one or more conditions for initiating the test, and the controller 130 may autonomously initiate the test based on detecting the condition(s). For example, the controller 130 may detect that the fluid pump 108 is inactive while a power source (e.g., an engine) for the fluid pump 108 is active (e.g., an engine for the fluid pump 108 is idling while a transmission for the engine and the fluid pump 108 is in neutral), and the controller 130 may initiate the test based on detecting that the fluid pump 108 is inactive while the power source is active.

The controller 130 may perform the test while the fluid pump 108 is inactive (e.g., when the fluid pump 108 is not pumping fluid, such as when the fluid pump 108 is stopped and/or when the transmission is in neutral). Moreover, the controller 130 may perform the test after a previous opening of the control valve 206 while the fluid pump 108 was active and a previous closing of the control valve 206. Thus, the discharge portion 202*a* of the recirculation circuit 202 may include fluid discharged from the fluid pump 108 (e.g., at high pressure) that is trapped in the discharge portion 202*a* of the recirculation circuit 202 from the previous closing of the control valve 206.

To initiate the test, the controller 130 may cause a pulse of the control valve 206 that opens the control valve 206 for a time interval (e.g., a few seconds) and closes the control valve 206. For example, starting with the control valve 206 in the closed position, the controller 130 may command the control valve 206 to briefly open and then close again. As described herein, the controller 130 may cause the pulse of the control valve 206 while the fluid pump 108 is inactive. Moreover, as described herein, the controller 130 may cause the pulse of the control valve 206 responsive to an input requesting a test of the check valve 204.

The controller 130 may monitor, in the time interval in which the control valve 206 is briefly opened, a pressure of the fluid in the discharge portion 202*a* of the recirculation circuit 202 to identify whether the pressure changes over the time interval. For example, the pressure may decay over the time interval or remain constant over the time interval. In some examples, the controller 130 may monitor a rate of pressure decay of the fluid in the discharge portion 202*a* of the recirculation circuit 202. To monitor the pressure, the controller 130 may obtain, from the discharge pressure sensor 210, information indicating the pressure at multiple (e.g., at least two) time points in the time interval. For example, the controller 130 may continuously (e.g., periodically with a sub-second periodicity), in the time interval, obtain the information indicating the pressure of the fluid in the discharge portion 202*a* of the recirculation circuit 202.

The controller 130 may determine whether the check valve 204 allows reverse flow based on the pressure of the fluid in the discharge portion 202*a* of the recirculation circuit 202 in the time interval. For example, the controller 130 may determine whether the check valve 204 allows reverse flow based on the rate of pressure decay. The check valve 204 allowing reverse flow may indicate that the check valve 204 is faulty (e.g., the check valve 204 has developed a leak or is otherwise defective).

The controller 130 may determine that the check valve 204 disallows reverse flow (e.g., the check valve 204 is not faulty) based on the pressure of the fluid decreasing in the time interval. For example, the controller 130 may determine that the check valve 204 disallows reverse flow based on the rate of pressure decay of the fluid being greater than zero. In some examples, the controller 130 may determine that the check valve 204 disallows reverse flow based on the pressure of the fluid decreasing at a rate (e.g., a constant rate) that satisfies a threshold. For example, the controller 130 may determine that the check valve 204 disallows reverse flow based on the rate of pressure decay satisfying the threshold. The threshold may be an expected rate of pressure decay, when the check valve 204 is not faulty, based on previous measurement or a CFD simulation. Thus, if the check valve 204 is disallowing reverse flow, then high pressure fluid downstream of the check valve 204 (e.g., from the manifold 110) will not flow to the discharge portion 202*a* of the recirculation circuit 202 during the pulse of the control valve 206, and the pressure will decrease at a predictable rate.

The controller 130 may determine that the check valve 204 allows reverse flow (e.g., the check valve 204 is faulty) based on the pressure of the fluid remaining constant (or increasing) in the time interval. For example, the controller 130 may determine that the check valve 204 allows reverse flow based on the rate of pressure decay being zero. In some examples, the controller 130 may determine that the check valve 204 allows reverse flow based on the pressure of the fluid decreasing at a rate that is below the threshold. For example, the controller 130 may determine that the check valve 204 allows reverse flow based on the rate of pressure decay being below the threshold. In particular, the pressure may decay at a slower rate when the check valve 204 is faulty than a rate at which the pressure decays when the check valve 204 is not faulty. Thus, if the check valve 204 is allowing reverse flow, then high pressure fluid downstream of the check valve 204 (e.g., from the manifold 110) will flow to the discharge portion of the recirculation circuit 202 during the pulse of the control valve 206, and the pressure will remain constant or decrease slower than expected.

In some implementations, the controller 130 may determine a severity of a leak in the check valve 204 based on the rate of pressure decay of the fluid. For example, if the rate of pressure decay is zero (i.e., the pressure remains constant when the check valve 204 is pulsed), then the controller 130 may determine that the leak in the check valve 204 has a first severity (e.g., a high severity). As another example, if the rate of pressure decay is greater than zero but below the threshold, then the controller 130 may determine that the leak in the check valve 204 has a second severity (e.g., a low severity). Moreover, for a non-zero rate of pressure decay, the controller 130 may determine that the leak in the check valve 204 has increasingly higher severity the closer the rate of pressure decay is to zero, and the controller 130 may determine that the leak in the check valve 204 has increasingly lower severity the closer the rate of pressure decay is to the threshold.

The controller 130 may perform one or more actions based on the pressure, in the time interval, of the fluid in the discharge portion 202*a* of the recirculation circuit 202 being indicative of the check valve 204 allowing reverse flow of the fluid (e.g., pressure decreasing or decreasing at a rate that satisfies a threshold may be indicative of the check valve 204 disallowing reverse flow, and the pressure remaining constant or decreasing at a rate that is below the threshold may be indicative of the check valve 204 allowing reverse flow, as described herein). For example, based on a determination that the check valve 204 allows reverse flow, the controller 130 may perform the action(s).

An action may include transmitting a signal to indicate that the check valve 204 allows reverse flow (e.g., to indicate that the check valve 204 is faulty). For example, the signal may cause an indicator light to illuminate, may cause a notification to be displayed in a user interface, may cause an alarm to activate, or the like. Additionally, or alternatively, an action may include transmitting a maintenance request for the pump system 104, generating a calendar entry scheduling maintenance for the pump system 104, and/or performing a transaction for purchasing a new check valve 204. Additionally, or alternatively, an action may include causing deactivation of the control valve 206 to prevent subsequent opening of the control valve 206 and fluid flow through the recirculation circuit 202. In some examples, the action performed by the controller 130 may be based on the severity of the leak in the check valve 204. For example, for a high severity leak, the controller 130 may cause deactivation of the control valve 206, whereas for a low severity leak, the controller 130 may transmit a maintenance request. In this way, the controller 130 may monitor the health of the check valve 204 to identify faults and perform remedial actions to reduce a likelihood of high pressure fluid upstream of the check valve 204 flowing in reverse through the recirculation circuit 202 and damaging the fluid pump 108.

As indicated above, FIG. 2 is provided as an example. Other examples may differ from what is described with regard to FIG. 2.

Figure 3:
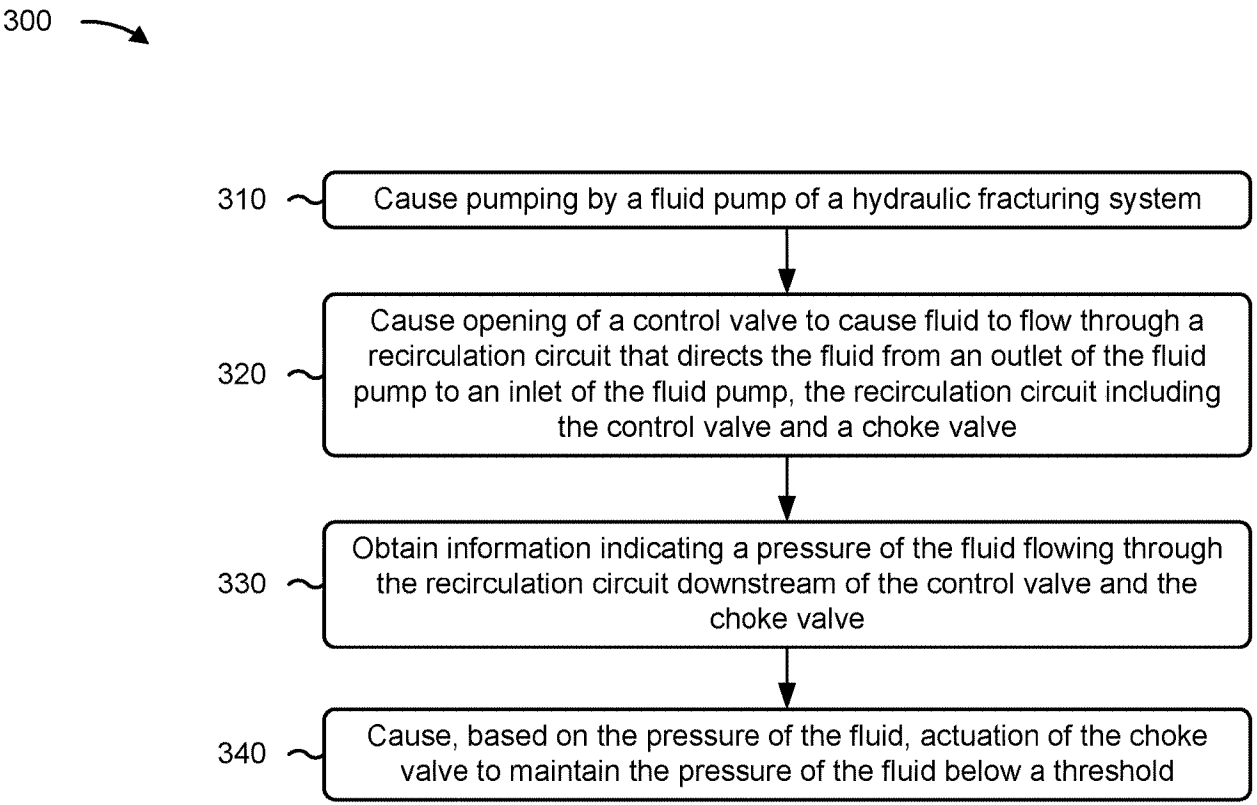
FIG. 3 is a flowchart of an example process associated with operation of a recirculation circuit for a fluid pump of a hydraulic fracturing system.

FIG. 3 is a flowchart of an example process 300 associated with operation of a recirculation circuit for a fluid pump of a hydraulic fracturing system. One or more process blocks of FIG. 3 may be performed by a controller (e.g., controller 130). Additionally, or alternatively, one or more process blocks of FIG. 3 may be performed by another device or a group of devices separate from or including the controller, such as another device or component that is internal or external to the hydraulic fracturing system 100. Additionally, or alternatively, one or more process blocks of FIG. 3 may be performed by one or more components of a device, such as a processor, a memory, an input component, an output component, and/or a communication component.

As shown in FIG. 3, process 300 may include causing pumping by a fluid pump of a hydraulic fracturing system (block 310). For example, the controller may cause pumping by a fluid pump of a hydraulic fracturing system, as described above.

As further shown in FIG. 3, process 300 may include causing opening of a control valve to cause fluid to flow through a recirculation circuit that directs the fluid from an outlet of the fluid pump to an inlet of the fluid pump, the recirculation circuit including the control valve and a choke valve (block 320). For example, the controller may cause opening of a control valve to cause fluid to flow through a recirculation circuit, as described above.

As further shown in FIG. 3, process 300 may include obtaining information indicating a pressure of the fluid flowing through the recirculation circuit downstream of the control valve and the choke valve (block 330). For example, the controller may obtain information indicating a pressure of the fluid flowing through the recirculation circuit downstream of the control valve and the choke valve, as described above. The information may be obtained from a pressure sensor configured to detect the pressure of the fluid flowing through the recirculation circuit downstream of the control valve and the choke valve.

As further shown in FIG. 3, process 300 may include causing, based on the pressure of the fluid, actuation of the choke valve to maintain the pressure of the fluid below a threshold (block 340). For example, the controller may cause, based on the pressure of the fluid, actuation of the choke valve to maintain the pressure of the fluid below a threshold, as described above. Causing actuation of the choke valve to maintain the pressure of the fluid below the threshold may include causing increasing of fluid flow through the choke valve to maintain the pressure of the fluid at a maximum pressure that is below the threshold. Causing actuation of the choke valve to maintain the pressure of the fluid below the threshold may include causing decreasing of fluid flow through the choke valve to maintain the pressure of the fluid below the threshold.

Causing actuation of the choke valve to maintain the pressure of the fluid below the threshold may include causing actuation of the choke valve continuously to maintain the pressure of the fluid below the threshold. Process 300 may include determining a difference between the pressure of the fluid and the threshold, and the actuation of the choke valve may be based on the difference. Process 300 may include causing closing of the control valve based on the pressure of the fluid being at or above the threshold and based on the choke valve being at a minimum flow position.

Although FIG. 3 shows example blocks of process 300, in some implementations, process 300 may include additional blocks, fewer blocks, different blocks, or differently arranged blocks than those depicted in FIG. 3. Additionally, or alternatively, two or more of the blocks of process 300 may be performed in parallel.

INDUSTRIAL APPLICABILITY

The control system described herein may be used with any hydraulic fracturing system that pressurizes hydraulic fracturing fluid using one or more fluid pumps. For example, the control system may be used with a hydraulic fracturing system that pressurizes hydraulic fracturing fluid using a fluid pump that utilizes a recirculation circuit.

The control system is useful for reducing the pressure of fluid discharged from the fluid pump before the fluid is recirculated to an input of the fluid pump. In particular, the control system may reduce the pressure of the discharged fluid to a level that is below a pressure containment capability at the input of the fluid pump. In this way, the control system may reduce a likelihood of leaking or failure of the fluid pump. Accordingly, the control system may prevent damage to the fluid pump and/or the hydraulic fracturing system as well as improve a useful life of the fluid pump and/or the hydraulic fracturing system.

Moreover, the control system is useful for reducing a velocity of fluid flowing through a control valve in the recirculation circuit during opening of the control valve. In particular, the control system may reduce the velocity to a safe level for the control valve. In this way, the control system may reduce abrasive wear to the control valve. Accordingly, the control system may prevent damage to the control valve and/or improve a useful life of the control valve.

Furthermore, the control system is useful for monitoring a health of a check valve located downstream of the recirculation circuit. In particular, the control system may determine whether the check valve is allowing reverse flow of high-pressure through the recirculation circuit, and the control system may perform a remedial action if it is determined that the check valve is allowing the reverse flow. Accordingly, the control system may prevent damage to the fluid pump and/or the hydraulic fracturing system as well as improve a useful life of the fluid pump and/or the hydraulic fracturing system.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of").

What is claimed is:

1. A pump system of a hydraulic fracturing system, comprising:

a fluid pump having an inlet and an outlet;

a recirculation circuit configured to direct fluid from the outlet of the fluid pump to the inlet of the fluid pump, wherein a first pressure containment capability of the outlet of the fluid pump is greater than a second pressure containment capability of the inlet of the fluid pump;

a control valve, in the recirculation circuit, configured for actuation between an open position and a closed position;

a choke valve, in the recirculation circuit, configured to provide a pressure drop from a discharge pressure of the fluid pump; and a controller configured to:

cause opening of the control valve to cause the fluid to flow through the recirculation circuit;

obtain information indicating a pressure of the fluid flowing through the recirculation circuit downstream of the control valve and the choke valve; and cause, based on the pressure of the fluid, actuation of the choke valve to maintain the pressure of the fluid below a threshold.

2. The pump system of claim 1, further comprising:

a pressure sensor configured to detect the pressure of the fluid flowing through the recirculation circuit downstream of the control valve and the choke valve, wherein the controller, to obtain the information, is configured to obtain the information from the pressure sensor.

3. The pump system of claim 1, wherein the controller, to cause actuation of the choke valve to maintain the pressure of the fluid below the threshold, is configured to:

cause increasing of fluid flow through the choke valve to maintain the pressure of the fluid at a maximum pressure that is below the threshold.

4. The pump system of claim 1, wherein the controller, to cause actuation of the choke valve to maintain the pressure of the fluid below the threshold, is configured to:

cause decreasing of fluid flow through the choke valve to maintain the pressure of the fluid below the threshold.

5. The pump system of claim 1, wherein the controller is further configured to:

cause closing of the control valve based on the pressure of the fluid being at or above the threshold and based on the choke valve being at a minimum flow position.

6. The pump system of claim 1, wherein the fluid pump is configured to discharge fluid to a manifold, and wherein the fluid discharged from the fluid pump is to enter the recirculation circuit upstream of the manifold.

7. The pump system of claim 1, wherein the inlet of the fluid pump includes an inlet manifold.

8. A control system, comprising:

a recirculation circuit configured to direct fluid from an outlet of a fluid pump of a hydraulic fracturing system to an inlet of the fluid pump;

a control valve in the recirculation circuit;

a choke valve in the recirculation circuit; and a controller configured to:

cause opening of the control valve to cause the fluid to flow through the recirculation circuit;

cause, based on a pressure of the fluid flowing through the recirculation circuit downstream of the control valve and the choke valve, actuation of the choke valve to maintain the pressure of the fluid below a threshold; and determine a difference between the pressure of the fluid and the threshold, wherein the actuation of the choke valve is based on the difference.

9. The control system of claim 8, wherein the controller is further configured to:

cause closing of the control valve based on the pressure of the fluid being at or above the threshold and based on the choke valve being at a minimum flow position.

10. The control system of claim 8, wherein the control valve is upstream of the choke valve.

11. The control system of claim 8, wherein the controller, to cause actuation of the choke valve to maintain the pressure of the fluid below the threshold, is configured to:

cause increasing of fluid flow through the choke valve to maintain the pressure of the fluid at a maximum pressure that is below the threshold.

12. The control system of claim 8, wherein the controller, to cause actuation of the choke valve to maintain the pressure of the fluid below the threshold, is configured to:

cause decreasing of fluid flow through the choke valve to maintain the pressure of the fluid below the threshold.

13. The control system of claim 8, wherein the controller, to cause actuation of the choke valve to maintain the pressure of the fluid below the threshold, is configured to:

cause actuation of the choke valve continuously to maintain the pressure of the fluid below the threshold.

14. The control system of claim 8, wherein the inlet of the fluid pump includes an inlet manifold.

15. The control system of claim 8, wherein the threshold is based on a pressure containment capability of the inlet of the fluid pump.

16. A method, comprising:

causing, by a controller, pumping by a fluid pump of a hydraulic fracturing system;

causing, by the controller, opening of a control valve to cause fluid to flow through a recirculation circuit that directs the fluid from an outlet of the fluid pump to an inlet of the fluid pump, the recirculation circuit including the control valve and a choke valve;

obtaining, by the controller, information indicating a pressure of the fluid flowing through the recirculation circuit downstream of the control valve and the choke valve; and causing, by the controller and based on the pressure of the fluid, actuation of the choke valve to maintain the pressure of the fluid below a threshold, wherein the threshold is based on a pressure containment capability of the inlet of the fluid pump.

17. The method of claim 16, wherein causing actuation of the choke valve to maintain the pressure of the fluid below the threshold comprises:

causing increasing of fluid flow through the choke valve to maintain the pressure of the fluid at a maximum pressure that is below the threshold.

18. The method of claim 16, wherein causing actuation of the choke valve to maintain the pressure of the fluid below the threshold comprises:

causing decreasing of fluid flow through the choke valve to maintain the pressure of the fluid below the threshold.

19. The method of claim 16, wherein a pressure containment capability of the outlet of the fluid pump is greater than the pressure containment capability of the inlet of the fluid pump.

20. The method of claim 19, further comprising:

determining, by the controller, a difference between the pressure of the fluid and the threshold, wherein the actuation of the choke valve is based on the difference.

* * * * *